US006311473B1

(12) United States Patent
Benjamin et al.

(10) Patent No.: US 6,311,473 B1
(45) Date of Patent: Nov. 6, 2001

(54) STABLE PRE-MIXER FOR LEAN BURN COMPOSITION

(75) Inventors: Michael A. Benjamin, Shaker Heights; Adel B. Mansour, Mentor, both of OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/517,823

(22) Filed: Mar. 2, 2000

Related U.S. Application Data

(60) Provisional application No. 60/126,206, filed on Mar. 25, 1999.

(51) Int. Cl.[7] ..... F02C 1/00; F23R 3/14; F23R 3/36

(52) U.S. Cl. ..... 60/39.06; 60/737; 60/39.463; 239/402; 239/403; 239/424; 431/181

(58) Field of Search ..... 60/39.06, 39.463, 60/737, 742, 748; 239/400, 402, 403, 422, 424, 424.5; 431/181

(56) References Cited

U.S. PATENT DOCUMENTS 3,703,259 * 11/1972 Sturgess et al. ..... 60/742
3,925,002 12/1975 Verdouw .
3,958,416 5/1976 Hammond, Jr. et al. .

(List continued on next page.)

FOREIGN PATENT DOCUMENTS

2086031 * 5/1982 (GB) ..... 60/737
62-247134 * 10/1987 (JP) ..... 60/748

OTHER PUBLICATIONS

Proposal entitled "Staged Premixer For Lean Premixed Prevaporized Combustion Of Liquid Hydrocarbon Fuels Used In Industrial Dry Low $NO_x$ Gas Turbine Combustors For Power Generation". This proposal was submitted by a third party to Parker–Hannifin Corporation more than one year before the filing date of the subject application. Applicants request the U.S. Patent Office consider this Proposal as a prior art reference for purposes of examination.

(List continued on next page.)

*Primary Examiner*—Ted Kim
(74) *Attorney, Agent, or Firm*—Christopher H. Hunter

(57) ABSTRACT

A combustion system includes a combustion chamber and a fuel injection apparatus, where a radial inflow swirler stage in the injector housing includes a plurality of radial inflow swirlers spaced longitudinally from each other to direct air radially inward in a swirling motion to cause fuel streams to swirl and thoroughly mix with air before passing into the combustion chamber. A plurality of liquid fuel nozzles are supported in the housing in an annular arrangement to dispense liquid fuel in a plurality of sprays in the downstream direction. A plurality of gaseous fuel nozzles are also provided in the housing supported in an annular arrangement intermediate the liquid fuel nozzles. The plurality of gaseous fuel nozzles include a series of nozzles arranged in radial spokes between each of the liquid fuel nozzles, with the size of the openings in the gaseous fuel nozzles increasing in the radially outer direction from the longitudinal axis of the housing. An outer annular flow passage is provided around the nozzles to create a cylindrical sheet of air around all the fuel streams, while an annular flow passage is provided around each of the liquid fuel nozzles to provide an annular flow of air around each of the liquid fuel sprays. A central air passage provides air centrally of the arrangement of nozzles. The air vaporizes the liquid fuel as the fuel passes downstream through the housing.

37 Claims, 8 Drawing Sheets

U.S. PATENT DOCUMENTS

| | | | | |
|---|---|---|---|---|
| 3,972,182 | * | 8/1976 | Salvi | 60/748 |
| 4,012,904 | * | 3/1977 | Nogle | 60/737 |
| 4,466,250 | * | 8/1984 | Mukaeda | 60/737 |
| 4,589,260 | * | 5/1986 | Krockow | 60/737 |
| 4,934,595 | * | 6/1990 | Reimer | 239/422 |
| 5,284,438 | * | 2/1994 | McGill et al. | 431/116 |
| 5,295,352 | | 3/1994 | Beebe et al. . | |
| 5,337,961 | * | 8/1994 | Brambani et al. | 60/742 |
| 5,344,307 | * | 9/1994 | Schwartz et al. | 431/181 |
| 5,467,926 | * | 11/1995 | Idelman et al. | 60/737 |
| 5,505,045 | | 4/1996 | Lee et al. . | |
| 5,540,056 | * | 7/1996 | Heberling et al. | 60/737 |
| 5,647,538 | | 7/1997 | Richardson . | |
| 5,836,163 | * | 11/1998 | Lockyer et al. | 60/737 |
| 6,016,658 | * | 1/2000 | Willis | 60/737 |
| 6,174,160 | | 1/2001 | Lee et al. . | |

OTHER PUBLICATIONS

Paper entitled "A Novel Premixer Design for Use In Lean Prevaporized and Premixed High–Intensity Combustion Systems". One of the individuals identified on the first page of this Paper, John C. Y. Lee, was a Ph.D. candidate at the University of Washington, Seattle, Washington, at the time, and had no obligation to assign any rights in the Premixer to Parker–Hannifin Corporation. The other two individuals were (and are) employees of Parker–Hannifin Corporation. Applicants request the U.S. Patent Office consider this Paper as a prior art reference for purposes of examination.

* cited by examiner

STABLE PRE-MIXER FOR LEAN BURN COMPOSITION

RELATED CASES

The present application claims priority to U.S. Provisional Application Serial No. 60/126,206; filed Mar. 25, 1999.

FIELD OF THE INVENTION

The invention relates to a fuel injection apparatus and method for pre-mixing fuel and air for combustion in a turbine combustion system.

BACKGROUND OF THE INVENTION

In a typical turbine engine, air is compressed, then mixed with fuel, and the resulting mixture is ignited in a combustor, so that the expanding gases of combustion can rapidly move across and thus rotate the turbine blades. The fuel can be liquid (e.g., Diesel Fuel #2) or gaseous (e.g., methane) or both, and the turbine can be an axial flow or a radial in-flow type. Such turbine engine can be used for industrial power or moving an airplane or ground vehicle. Variable or fixed turbine vanes direct the expanded gases from the combustor to the rotatable turbine blades.

Air polluting emissions are an undesirable bi-product of turbine engines. The primary air pollution emissions produced by turbines burning conventional hydrocarbon fuels are oxides of nitrogen ($NO_x$), carbon monoxide (CO) and unburned hydrocarbons. It is well known that oxidation of molecular nitrogen in air-breathing engines is dependent upon the flame temperature in the reaction zone. The rate of chemical reactions forming oxides of nitrogen is an exponential function of temperature. Consequently, if the flame temperature is controlled to a low level, thermal $NO_x$ production will be reduced.

A typical and preferred method of controlling the temperature of the reaction zone of a turbine combustor below the level at which thermal $NO_x$ is formed consists of pre-mixing the fuel and air to a lean mixture prior to combustion. The mass of the excess air present in the reaction zone of a lean, pre-mixed combustor absorbs heat and reduces the temperature rise of the products of combustion to a level where $NO_x$ production is substantially reduced. However, the fuel/air mixture strength should be somewhat higher than the lean flammability limit in order to prevent or eliminate combustion oscillations. It is generally known that lean, pre-mixed combustors tend to be less stable than more conventional diffusion flame combustors and do not provide adequate turn down for operation over the entire load range of the turbine. Stability for operation over all load conditions required for turbine operations, with minimum emissions of air pollutants in the turbine exhaust, is an ongoing challenge in the industry.

For liquid fuel turbine engines, another challenge is that it is desirable to pre-vaporize the fuel prior to entry into the combustion chamber. Pre-vaporizing the liquid fuel maximizes the combustion efficiency of the engine and minimizes pollution and stability problems. However, it is believed that in even the most efficient systems, full pre-vaporization of the fuel has not been achieved, that is, the fuel is not completely pre-mixed at the molecular level with the air prior to combustion. Consequently, flame temperature and $NO_x$ formation rates are higher than what is believed achievable in fully pre-mixed, pre-vaporized systems. Steam and/or water are many times injected into the. combustor primary zone to reduce and control formation of the oxides of nitrogen. However, the additional requirement of a steam and/or water injection system greatly increases the capital operating and maintenance costs of the turbine.

Another method of $NO_x$ control is with the use of catalytic combustors. This technique also raises capital, operating and maintenance costs issues with the turbine. There are also technological issues, such as material and structural integrity of the catalyst under high temperature and thermal cycling conditions, which must be resolved. It is also believed that the use of catalytic combustion has not been successfully demonstrated for oil fired combustion turbines.

As such, it is believed that there is a demand in the industry for an improved fuel injection apparatus for a turbine combustion system, where the system has clean and stable operation, and which does not require secondary control of $NO_x$ formation.

SUMMARY OF THE PRESENT INVENTION

The present invention provides a novel and unique fuel injection apparatus for a turbine combustion system which vaporizes the liquid fuel and thoroughly and completely mixes liquid fuel with air prior to ignition in the combustion chamber for clean, stable combustion. The apparatus does not require secondary systems for the control of $NO_x$ emissions.

According to the present invention, the fuel injection apparatus includes one or more liquid fuel dispensing nozzles at an upstream end of the injector housing. Gaseous fuel nozzles can also be provided. At least one, and alternatively two (or more) radial inflow swirlers are longitudinally spaced apart from one another downstream from the fuel dispensing nozzles. The radial inflow swirler(s) direct air radially inward in a swirling motion to cause the fuel streams to swirl and thoroughly mix with air in the housing. The axial staging of the radial inflow swirlers reduces droplet dispersion towards the walls of the injection apparatus. Since the swirling flow is introduced incrementally along the injector housing, the swirl number of the air entering the housing increases from the base of the housing to its exit. Liquid fuel is introduced at the base of the housing in regions of low swirl intensity thereby minimizing droplet lateral dispersion and deposition on the walls of the housing. Most of the swirl is introduced towards the exit of the injection apparatus where the mean droplet size has decreased substantially as a result of droplet vaporization. It is to be noted that small droplets are less affected by the centrifuging action of the swirling flow field thereby reducing fuel flux towards the injection apparatus walls.

The liquid fuel nozzles have a macrolaminate structure and are configured to provide fine, conical sprays of fuel. The liquid fuel nozzles and gaseous fuel nozzles are supported at an annular arrangement substantially perpendicular to the longitudinal axis of the housing, with the gaseous fuel nozzles in alternating circumferential relation with the liquid fuel nozzles.

The annular arrangement of gaseous fuel nozzles includes a series of such nozzles between each of the liquid fuel nozzles. The series of gaseous fuel nozzles are arranged in radial spokes projecting outwardly from the longitudinal axis of the housing between the liquid fuel nozzles. The fuel passages in the gaseous fuel nozzles disposed radially further away from the longitudinal axis of the housing are larger to optimize the distribution of gaseous fuel in the housing.

An outer annular flow passage surrounds the nozzles to direct air in a cylindrical sheet around the fuel streams.

Individual annular flow passages also surround each of the liquid fuel nozzles. The air flows vaporize the liquid fuel spray as it passes downstream through the housing. The air flows also provide momentum to carry the liquid and gaseous fuel through the housing and penetrate the swirling air provided by the swirlers, and prevent fuel accumulation along the walls of the housing.

An inner air passage is supported centrally in the housing to direct air in the downstream direction centrally of the fuel streams. The inner air flow prevents recirculating zones in the upstream end of the housing and also assists in vaporizing and providing momentum to the fuel.

After the vaporized fuel and air are thoroughly and completely mixed in the housing and are traveling in a swirling motion, the mixture passes into the combustor where the mixture is ignited to rotate the turbine blades.

A method is also provided for pre-mixing fuel within an injector for a turbine engine, including i) spraying liquid fuel through one or more nozzles in the housing; ii) vaporizing the fuel air as the fuel passes downstream through the housing; iii) thoroughly and completely mixing the vaporized fuel with swirling air such that the mixture is traveling in a swirling motion; and iv) directing the swirling mixture into a combustion chamber of the turbine for clean, stable combustion.

Gaseous fuel can also be provided alternatively or in addition to the liquid fuel through a plurality of nozzles supported in alternating circumferential relation with the liquid fuel nozzles, in which case the method includes i) dispensing the gaseous fuel through the gaseous fuel nozzles; ii) thoroughly and completely mixing the gaseous fuel with swirling air such that the mixture is traveling in a swirling motion; and iii) directing the swirling mixture into the combustion chamber for clean, stable combustion.

Such an injection apparatus and method as described above has been found to significantly reduce the dynamic instabilities in the combustor and reduce the air polluting emissions of the turbine system. No secondary control of $NO_x$ emissions is necessary.

Further features and advantages of the present invention will become apparent to those skilled in the art upon reviewing the following specification and attached drawings.

DETAILED DESCRIPTION OF THE PREFERRED EMBODIMENT

Figure 1:
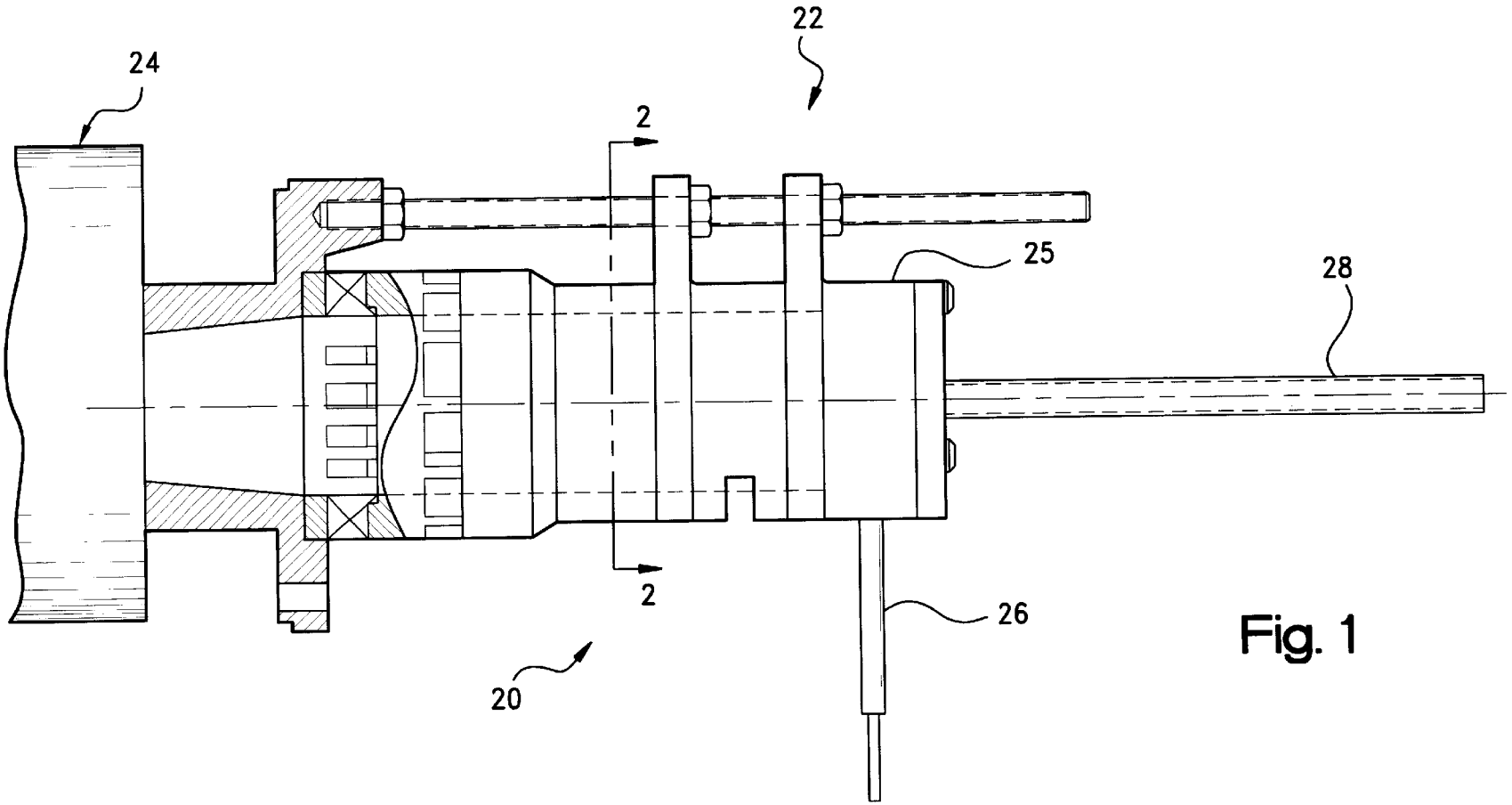
FIG. 1 is a side view in partial cross-section of a portion of a turbine combustion system.
Figure 2:
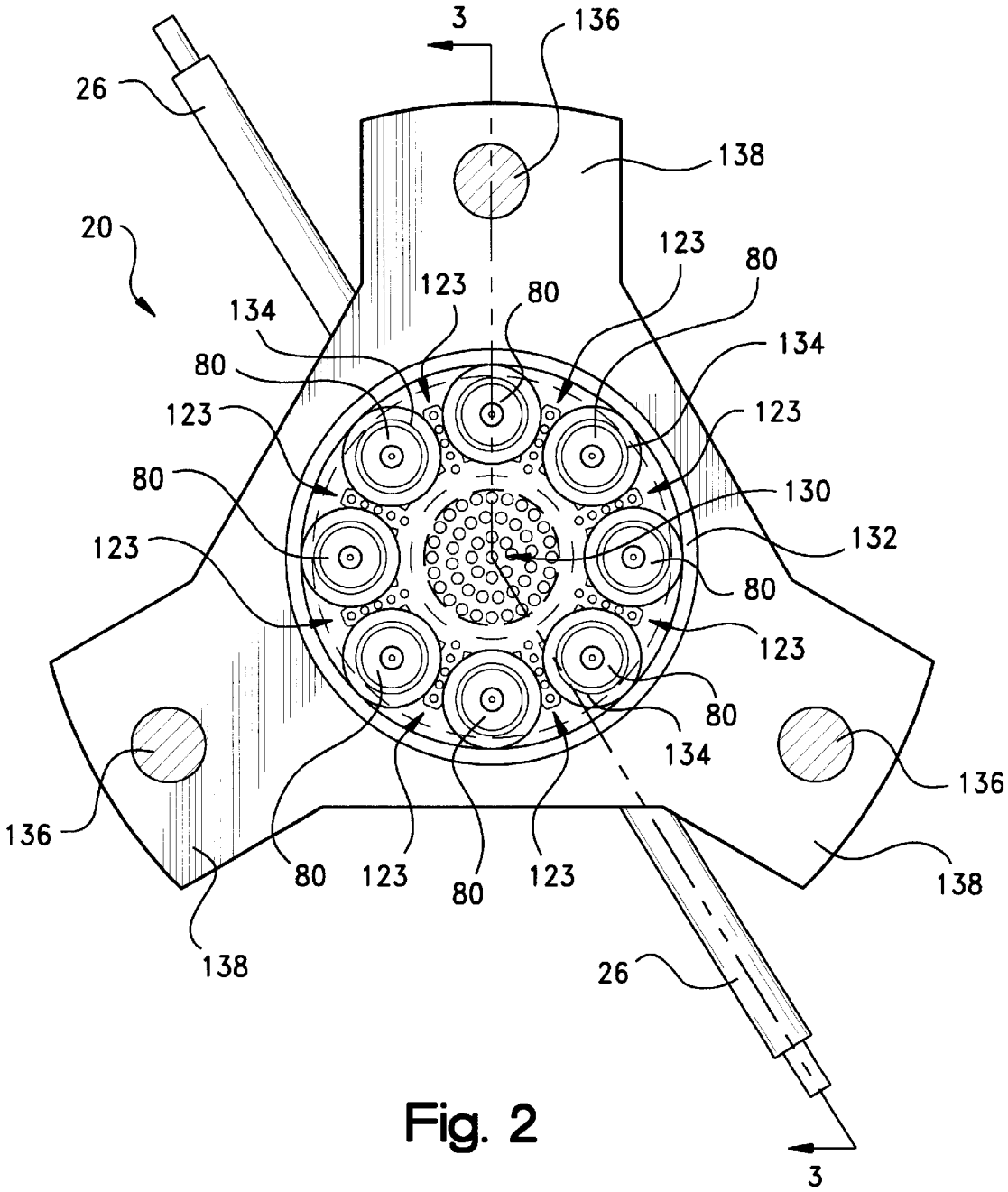
FIG. 2 is a cross-sectional end front view of the fuel injection apparatus for the turbine combustion system taken substantially along the plane described by the lines 2—2 of FIG. 1.

Referring to the drawings and initially to FIGS. 1 and 2, a turbine combustion system is indicated generally at 20. The system includes a fuel injection apparatus, indicated generally at 22, and a combustion chamber, indicated generally at 24. The fuel injection apparatus includes a housing 25 with liquid fuel provided to the housing through a pair of radially-projecting inlet tubes 26, and gaseous fuel provided through an axially-extended inlet tube 28. The liquid and gaseous fuel can be provided simultaneously, or one fuel can be used as a primary fuel and the other fuel used as a secondary (or back-up) fuel.

Combustion chamber 24 is conventional in design and will not be described in detail. The combustion chamber 24 is preferably any of the commercially-available cylindrical or annular types of combustion chambers, as should be well-known to those skilled in the art. Multiple combustion chambers can also be provided, if necessary or desirable. In addition, while a single fuel injection apparatus will be described herein with respect to combustion chamber 24, it should also be understood that multiple fuel injection apparatus could be provided with one (or more) combustion chambers.

Figure 3:
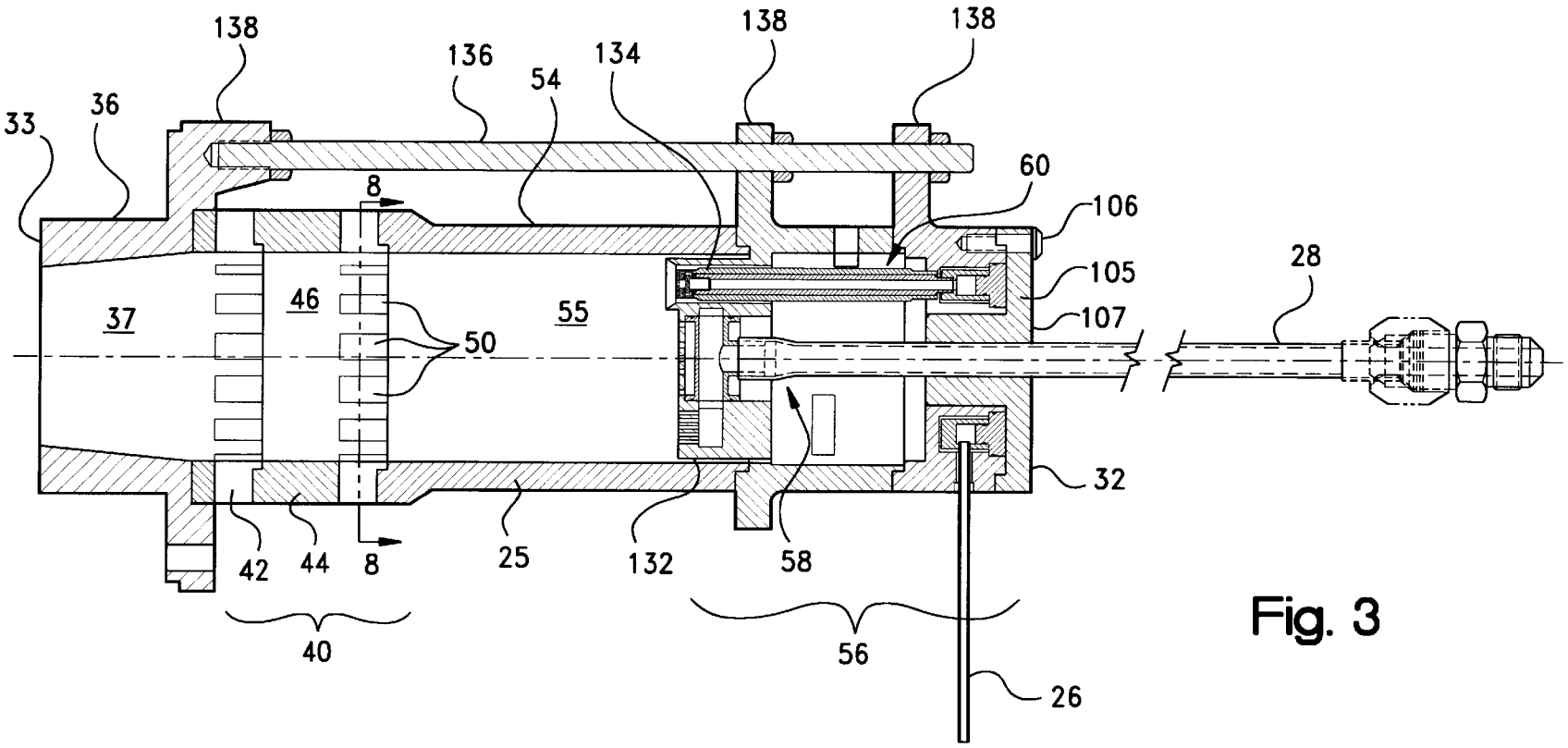
FIG. 3 is a cross-sectional side view of the fuel injection apparatus taken substantially along the plane described by the lines 3—3 of FIG. 2.

Referring now to FIG. 3, injector housing 25 has a longitudinally-extending, generally cylindrical configuration, with an upstream end 32 and a downstream end 33. The downstream end 33 is adapted to be fluidly connected to the combustion chamber in a conventional manner (e.g., using fasteners, brazing, etc.). Preferably, the housing 25 is formed from multiple components, which enables the housing to be easily manufactured, assembled and tested, although the housing could likewise be formed in only a single component. The housing includes a downstream accelerator nose portion 36 having a cylindrical inner passage 37 that tapers or constricts radially inwardly toward downstream end 33. The taper of the nose portion accelerates the fuel mixture as the mixture enters the combustion chamber, and prevents flame flashback.

Figure 8:
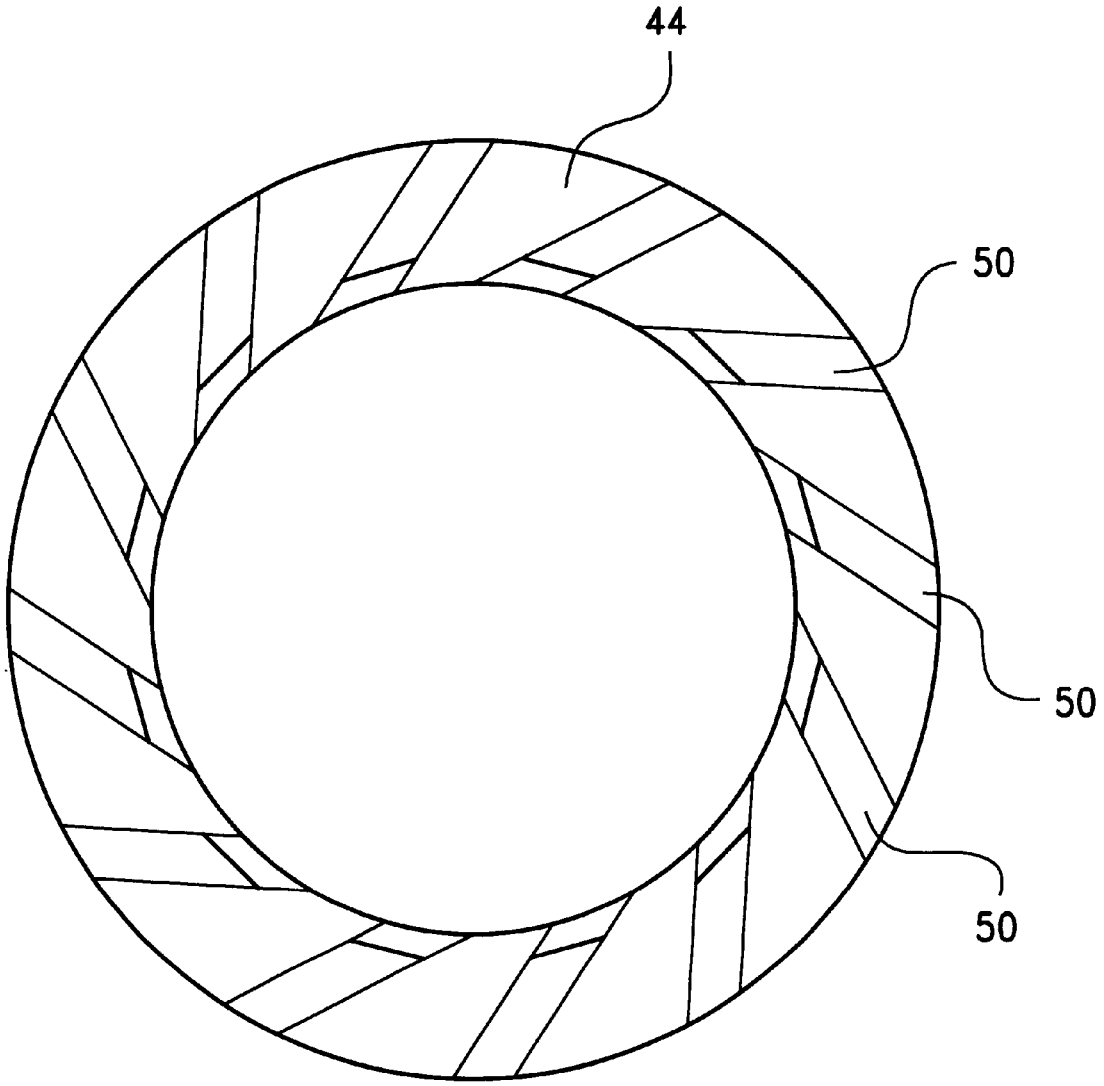
FIG. 8 is a cross-sectional end view of one of the air swirlers of the fuel injection apparatus of FIG. 2.

A radial inflow air swirler stage, indicated generally at 40, is next provided adjacent to, and upstream from accelerator nose portion 36. Air swirler stage 40 includes at least one radial air flow swirler which directs air radially inward in a swirling motion into housing 25. Preferably, the radial inflow swirler stage 40 includes a pair of air swirlers, 42, 44, each of which defines a cylindrical inner passage 46. Each air swirler 42, 44 has a plurality of air flow passages into inner passage 46 which create air swirl patterns in the housing. As can be seen in FIG. 8, a plurality of air passages as at 50 are formed in the upstream air swirler 44 to direct air radially inward in a swirling motion. Passages 50 are equally spaced around the circumference of the swirler, and extend non-radially into the housing. While the angle for the passages can vary, it has been found that an angle of about 30 degrees from the longitudinal axis of the housing for all of the passages provides a satisfactory swirl. The number of passages in swirler 44, and the dimensions of the passages can vary depending upon the particular application (i.e., the desired "swirl"). Swirler 42 has a similar number and arrangement of air passages as swirler 44. The air swirlers 42, 44 preferably provide the same volume of air at the same swirl angle, in the same swirl direction, and at the same temperature, although, again, this could vary depending upon the particular application.

The swirl passages in the upstream air swirler 44 are preferably located at a point where the liquid fuel dispensed in the housing is fully or essentially fully vaporized by the air temperatures in the housing. The passages in the downstream air swirler 42 are preferably located adjacent or at least close to the constricting portion of the accelerator nose portion 36. The swirl passages in the air swirlers 42, 44 are spaced longitudinally apart from each other enough to provide two distinct air swirl patterns in the housing. The "staging" of the air swirlers (i.e., providing incremental swirling along the longitudinal length of the housing) reduces droplet dispersion towards the walls of the injection apparatus. Since the swirling flow is introduced incrementally along the injector housing, the swirl number of the air entering the housing increases from the base of the housing to its exit. Liquid fuel is introduced at the base of the housing in regions of low swirl intensity thereby minimizing droplet lateral dispersion and deposition on the walls of the housing. Most of the swirl is introduced towards the exit of the injection apparatus where the mean droplet size has decreased substantially as a result of droplet vaporization. It is to be noted that small droplets are less affected by the centrifuging action of the swirling flow field thereby reducing fuel flux towards the injection apparatus walls. Further, and most importantly, the staging provides thorough and complete mixing of the swirling fuel and air before the mixture enters the combustion chamber for clean and stable combustion.

A spacer 54 is next provided adjacent to and upstream from the air swirler stage 40. Spacer 54 includes a cylindrical inner passage 55. Spacer 54 provides the longitudinal spacing sufficient for full (or substantially full) vaporization of the liquid fuel by the elevated air temperatures in the housing as the fuel passes downstream to the swirler stage.

A fuel injection stage, indicated generally at 56, is next provided upstream of spacer 54. Fuel injection stage 56 includes an inlet gas assembly, indicated generally at 58, and an inlet fuel assembly, indicated generally at 60.

Figure 6:
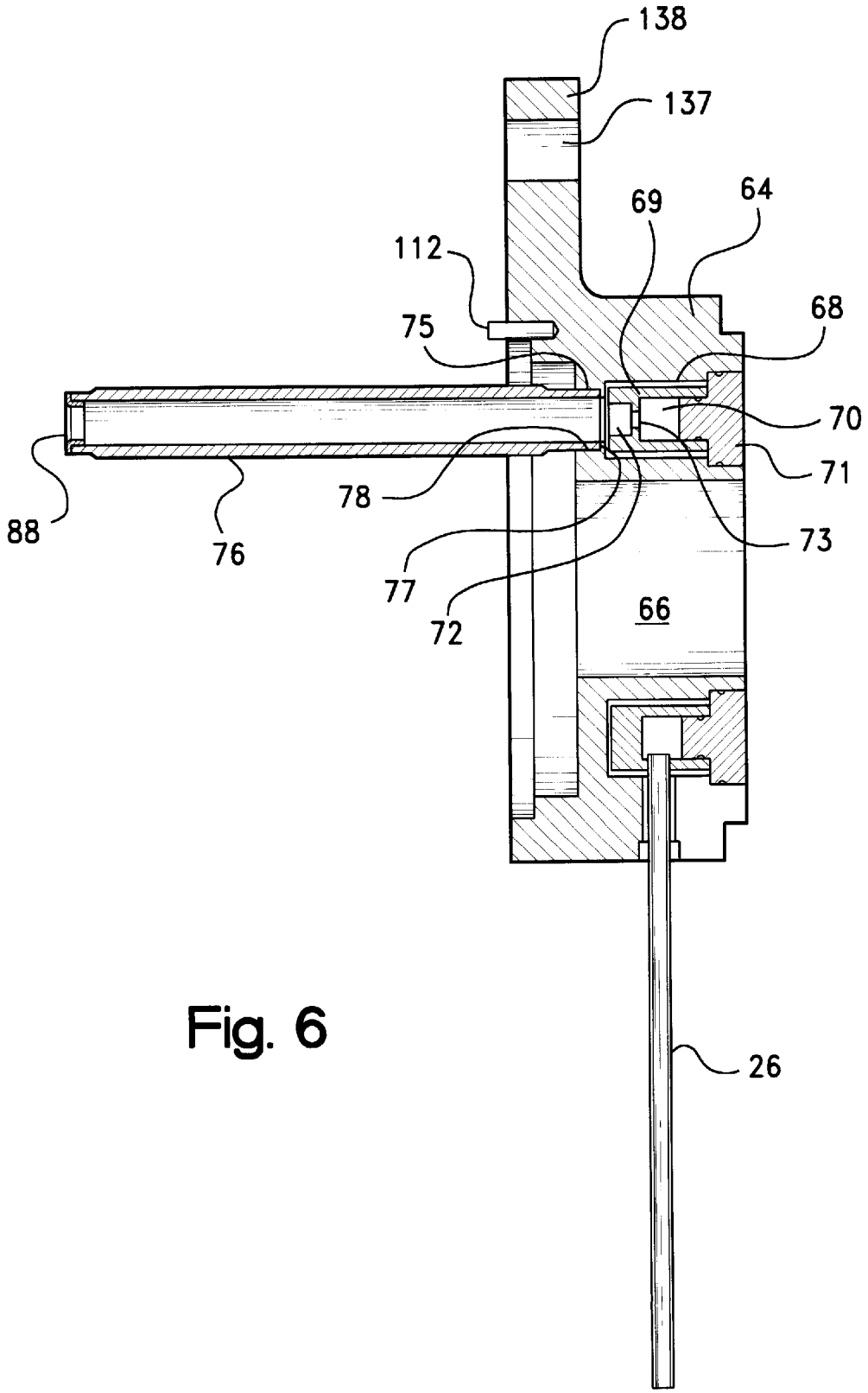
FIG. 6 is a cross-sectional side view of the inlet fuel assembly of the fuel injection apparatus.
Figure 7A:
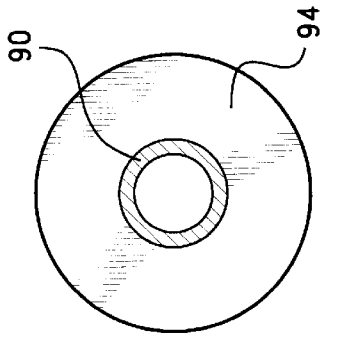
FIG. 7A is a cross-sectional end view through a liquid fuel nozzle taken substantially along the plane described by the lines 7A—7A of FIG. 7.
Figure 7B:
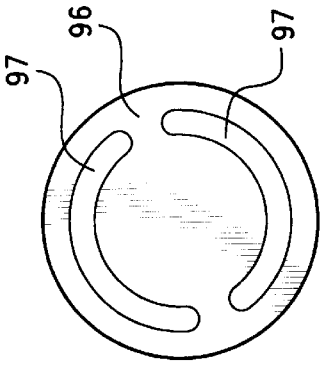
FIG. 7B is a cross-sectional end view through a liquid fuel nozzle taken substantially along the plane described by the lines 7B—7B of FIG. 7.
Figure 7C:
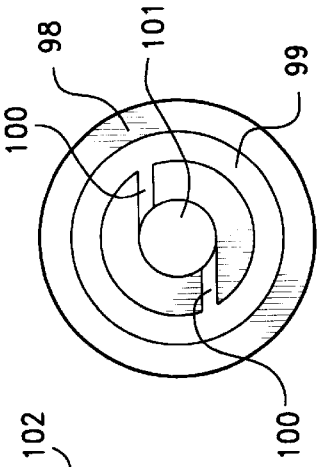
FIG. 7C is a cross-sectional end view through a liquid fuel nozzle taken substantially along the plane described by the lines 7C—7C of FIG. 7.
Figure 7D:
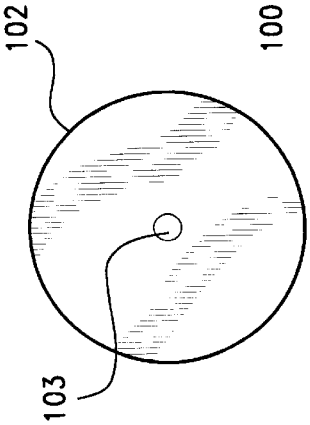
FIG. 7D is a cross-sectional end view through a liquid fuel nozzle taken substantially along the plane described by the lines 7D—7D of FIG. 7.
Figure 7:
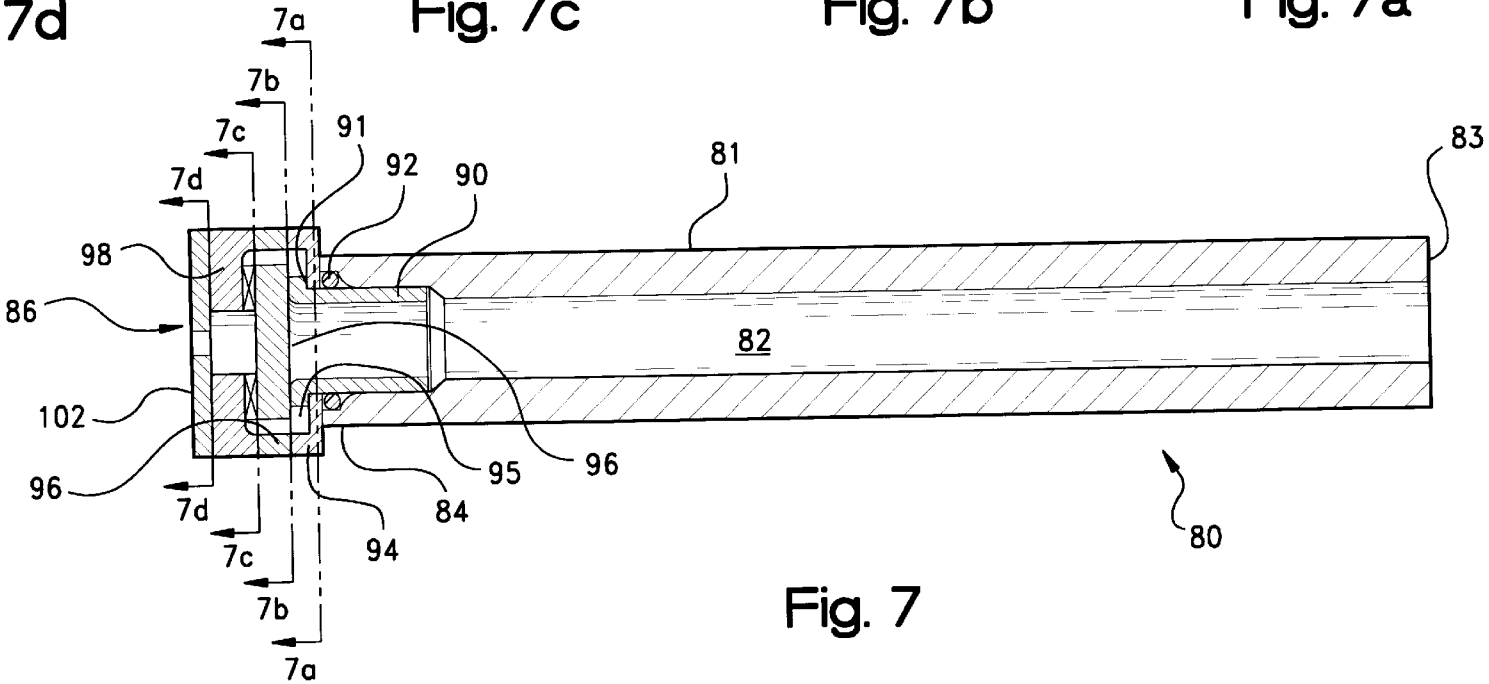
FIG. 7 is a cross-sectional view of the nozzle assembly for the inlet fuel assembly of FIG. 6.

Referring now to FIGS. 6 and 7, the inlet fuel assembly 60 includes a main body 64 having a cylindrical inner passage 66. An annular channel 68 is provided in body 64 spaced radially outward from inner passage 66 and opening toward the upstream end of the housing. An annular fuel chamber 69 is disposed within channel 68, and includes an annular main fuel channel 70, also opening toward the upstream end of the housing. The inlet fuel tubes 26 extend through body 64, and through chamber 69 into main channel 70, to provide liquid fuel to the main channel. Inlet tubes 26 can be fixed to chamber 69 such as by brazing or any other appropriate manner. An annular T-shaped (in cross-section) seal cap 71 closes the upstream end of channel 68, as well as closes channel 70. Seal cap 71 can also be fixed to body 64 such as by brazing.

A plurality of cylindrical, axially-extending fuel passages 72 are provided in fuel chamber 69, from the downstream end of the chamber. Each fuel passage 72 is fluidly connected to main fuel channel 70 through a small passage 73. Fuel passages 72 are preferably equally-spaced in an annular arrangement around chamber 69. Fuel provided through inlet tube 26 is thereby evenly distributed to fuel passages 72.

A plurality of cylindrical, axially-extending passages 75 are also provided from the downstream end of main body 64 into annular channel 68. The passages 75 are preferably equally spaced in an annular arrangement, and are circumferentially aligned and in fluid communication with passages 72 in fuel chamber 69. A heat shield tube 76 is closely received within each of the passages 75. The heat shield tube 76 abuts an annular flange 77 provided at the upstream end of passage 75, and can be fixed to the main body 64 such as by brazing. An O-ring 78 can also be provided to ensure a tight seal between the heat shield tube 76 and main body 64.

A nozzle assembly, indicated generally at 80, is received within each heat shield tube 76. Nozzle assembly 80 includes a cylindrical fuel tube 81 having an inner cylindrical fuel passage 82. The tube 81 has an upstream end 83 and a downstream end 84. Tube 81 is closely received within the heat shield tube, with the upstream end 83 received through the annular flange 77 in body 64, and into passage 72 in fuel chamber 69. Tube 81 can be fixed to the chamber 69 in an appropriate manner, such as by brazing. Fuel in main channel 70 can thereby pass through passages 73 into passages 72, and then into fuel tube 81.

The nozzle assembly 80 further includes a spray tip assembly, indicated generally at 86, at the downstream end 84 of the fuel tube which provides a fine, conical spray of fuel. The spray tip assembly 86 is held within a cylindrical adapter 88 at the downstream end of the heat shield tube 76. Adapter 88 closely retains nozzle assembly 80 and allows thermal expansion of fuel tube 81 within heat shield tube 76. Adapter 88 can be fixed to heat shield tube 76 such as by brazing. The downstream end of the heat shield tube (and nozzle assembly) extends axially through and is supported within a cylindrical passage 89 (FIG. 4) in the inlet gas assembly 58.

The spray tip assembly 86 is preferably an atomizing spray nozzle with a macrolaminate (multiple plate) structure. To this end, tip assembly 86 includes a cylindrical inlet adapter 90 (FIG. 7A), with an integral downstream annular flange 91. Inlet adapter 90 is fluidly sealed to tube 81 by an O-ring seal 92, and by brazing.

An annular inlet plate 94 surrounds the downstream end of inlet adapter 90, and abuts the annular flange 91. Inlet plate 94 includes a cup-shaped cavity 95, and cylindrical inlet adapter 90 includes arcuate radial openings into chamber 95, to fluidly connect fuel passage 82 with chamber 95. Inlet plate 94 can also be brazed to tube 81.

A distribution plate 96 (FIG. 7B) is disposed against the downstream end of inlet plate 94. Distribution plate 96 includes a pair of arcuate flow channels 97 in fluid communication with chamber 95 of inlet plate 94. Distribution plate 96 is brazed to inlet plate 94.

A swirl plate 98 is next disposed against the downstream end of distribution plate 96. Swirl plate 98 includes an annular flow channel 99 in fluid communication with arcuate openings 97 in distribution plate 96. Annular flow channel 99 is fluidly connected through non-radial passages 100 to a central, cylindrical swirl chamber 101. Passages 100 create a vortex swirl within swirl chamber 101. Swirl plate 98 is brazed to distribution plate 96.

Finally, an orifice plate 102 is disposed against the downstream end of swirl plate 98. Orifice plate 102 includes a central circular opening 103, which is in fluid communication with swirl chamber 101 in swirl plate 98. Opening 103 provides a fine conical, fully-atomized spray through the distal end of nozzle assembly 80. Orifice plate 100 is brazed to swirl plate 98.

The various plates 94, 96, 98, 102 of the spray tip assembly 86 can be formed using conventional techniques, and are preferably formed using a chemical etching technique disclosed in U.S. Pat. No. 5,740,967, which is hereby incorporated by reference. While four such plates are shown, it is noted that the spray tip assembly could be formed using fewer (or more) plates, as described in U.S. Pat. No. 5,740,967.

Preferably, a plurality of such nozzle assemblies 80 are disposed within housing 25 in a planar array. As shown in FIG. 2, eight such nozzle assemblies 80 are shown disposed in an equally-spaced, annular arrangement perpendicular to the longitudinal axis of the housing. Each of the nozzle assemblies extends through a cylindrical passage 89 in gas inlet assembly body 109, is protected by a heat shield tube 76, and is in fluid communication with main fuel channel 70. The nozzle assemblies provide the fuel sprays at the same longitudinal location in the housing. The number of such nozzle assemblies can vary, and at a minimum a single nozzle assembly can be used within the housing. However, it is preferred that at least three, and even more preferably at least eight, such nozzle assemblies are used with the fuel injection apparatus of the present invention.

As shown in FIG. 3, an annular end cap 105 with a T-shape (in cross-section) is provided to fluidly-seal the upstream end of housing 25. End cap 105 is fixed to body 64 of the inlet fuel assembly by a series of threaded bolts 106 which are received within through-bores in end cap 105 and corresponding threaded bores in body 64. End cap 105 includes a central opening 107 which closely receives inlet gas tube 28.

Figure 4:
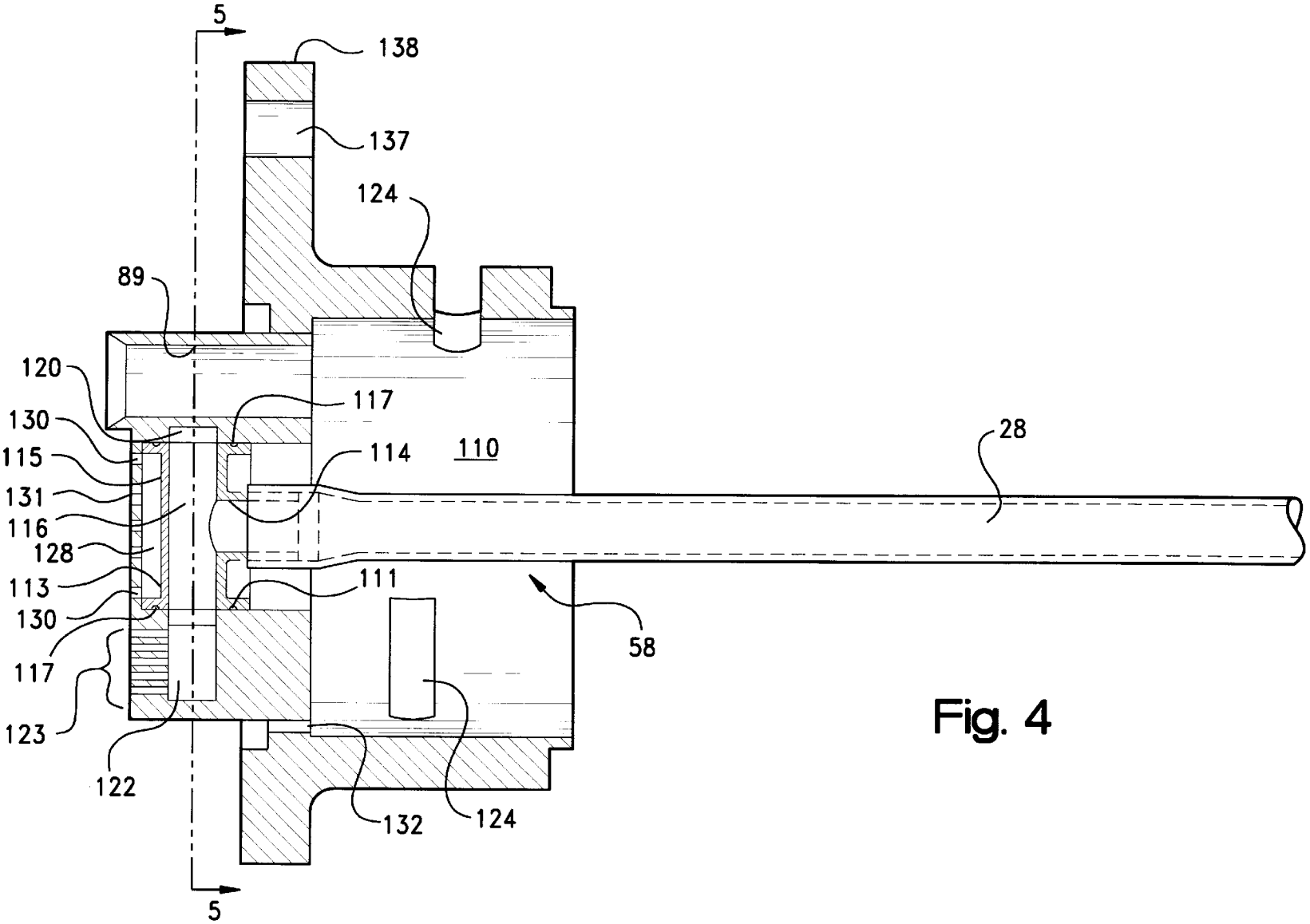
FIG. 4 is a cross-sectional side view of the inlet gas assembly for the fuel injection apparatus.

Referring now to FIG. 4, the inlet gas assembly 58 includes a main body 109 which defines a central cylindrical passage 110 opening to the upstream end of the body 109. A narrower cylindrical passage 111 is provided from passage 110 to the downstream end of the body. Body 109 is disposed at the upstream end of spacer 54. while body 64 of the inlet fuel assembly 60 is disposed at the upstream end of gas assembly body 109. A dowel 112 (FIG. 6) can be provided between body 64 of the inlet fuel assembly and the body 109 of the inlet gas assembly, to properly rotationally orient the inlet fuel assembly with the inlet gas assembly.

The inlet gas assembly includes an inlet tube assembly including inlet tube 28 and a gas distributor 113. Gas distributor 113 has a T-shape (in cross-section) and includes a tubular neck 114 received within the downstream end of tube 28 (and brazed thereto), and a tubular body 115 oriented perpendicular to neck 114. A T-shaped flow passage 116 is provided in gas distributor 113 to direct gaseous fuel from inlet tube 28 in a radially outward direction. A pair of rings 117 can be provided at the radially outer ends of the tubular body 115 to fluidly-seal the gas distributor within passage 111.

Figure 5:
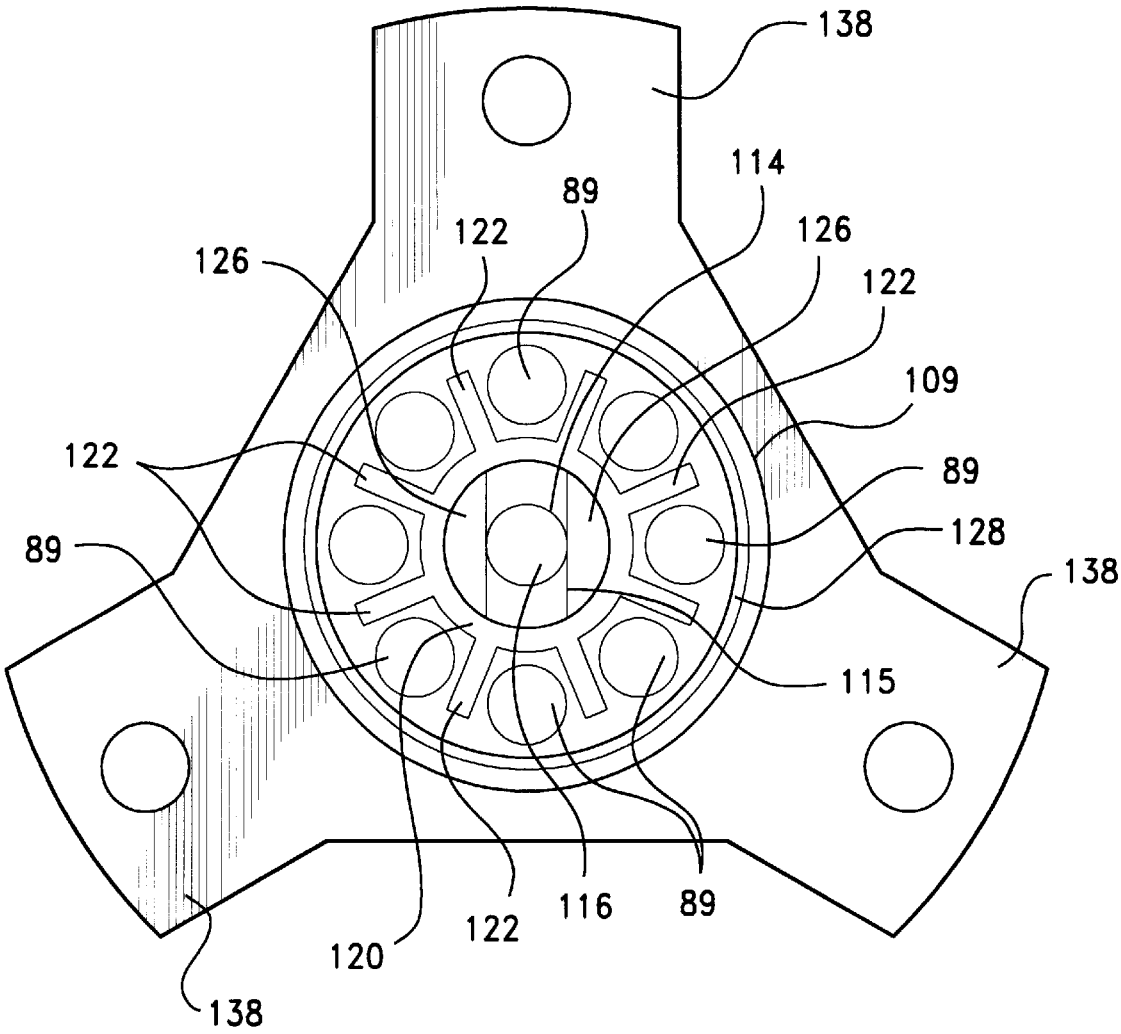
FIG. 5 is a cross-sectional end view taken substantially along the plane described the lines 5—5 of FIG. 4.

As also shown in FIGS. 2 and 5, an annular channel 120 in gas assembly body 109 surrounds tubular body 115 of the gas distributor and distributes the fuel from flow passage 116 circumferentially around the gas distributor. A series of radially outward-extending channels or spokes, as at 122, extend radially outward from channel 120, between openings 89 supporting the liquid fuel nozzle assemblies. Body 109 includes axial passages, as at 123, into radial channels 122, which define gas flow nozzles between the liquid fuel nozzles. The gas flow nozzles are spaced in an annular arrangement perpendicular to the longitudinal axis of the housing, in alternating circumferential relation with the liquid fuel nozzles. As can be seen in FIG. 2, a series of gas flow nozzles are provided into each of the radial channels 122 between the liquid fuel nozzles. While five of such gaseous fuel nozzles are illustrated into each radial channel, the number of the nozzles into each channel can vary depending upon the particular application (e.g., the desired gas flow). The diameters of the gas flow nozzles preferably increases in the passages located radially further away from the longitudinal axis of the housing, for the even distribution of gaseous fuel across the diameter of the housing. Thus, gaseous fuel received through gaseous inlet tube 28, is evenly distributed to the gaseous fuel nozzles between the liquid fuel nozzles.

Upstream air inlet passages 124 are also provided in body 109 of the inlet gas assembly. Air inlet passages 124 are preferably equally spaced around the body 109 to direct air radially inward into passage 110. Preferably three such passages are provided, however, the location, number (and dimensions) of passages 124 can vary depending upon the particular application (e.g., desired air flow into the upstream portion of the housing). The air is provided at elevated temperatures (typically at least 500° F.) with the same volume of air preferably provided into the upstream air inlet passages 124 as into each of the air swirler stages 42, 44.

Openings 126 provided on opposite sides of gas distributor body 115 (see FIG. 5) direct the air from passage 110 into a forward circular chamber 128. The air is then directed through axial passages as at 130 formed in the downstream wall 131 of body 109 into chamber 128. As can be seen in FIG. 2, passages 130 are concentrically disposed in radially increasing annular arrangements, to provide an even flow of air centrally within housing 25, and centrally within the fuel streams provided by gaseous fuel nozzles 123 and liquid fuel nozzles 80. The air provided by passages 130 prevents recirculating zones from forming in the upstream portion of the housing, and assists in vaporizing the fuel sprays from the liquid fuel nozzles. The number, location and dimension of openings 130 can also vary depending upon the particular application (e.g., the desired air flow through the central portion of the housing 25).

An outer annular air flow passage 132 is also provided from chamber 110. Air flow passage 132 extends in circumferentially surrounding relation to liquid fuel nozzles 80 and gaseous fuel nozzles 123. Air flow passage 132 provides a cylindrical sheet of air downstream through the housing between the liquid and gas streams and the walls of the housing. The sheet of air prevents fuel accumulation along the walls of the housing, and assists in vaporizing the liquid fuel sprays.

Finally, individual annular air flow passages as at 134 (FIG. 2) are provided from chamber 110 surrounding each of the liquid fuel nozzles 80. The air flow passages 134 are defined by an annular gap or space between each of the nozzles 80 and the cylindrical passage 89. Individual air flow passages 134 provide cylindrical sheets of air around each of the liquid fuel sprays to assist in the vaporization of the fuel. The individual air flow passages 134 dispense the air at about the same longitudinal location as the outer annular air passage 132. The dimensions of passages 134 can also vary depending upon the particular application (e.g., the desired air flow around each of the liquid fuel sprays).

The air flows from annular outer passage 132, individual annular passages and from central passages 130 are also sufficient to provide momentum to the fuel streams to cause the fuel streams to travel downstream in housing 25 and penetrate the swirling air flows from swirlers 42, 44. The air provided to air swirlers 42, 44 is also provided at (the same) elevated temperatures to vaporize any remaining fuel, if necessary or desirable.

The nose portion 36; air swirler stage 40; spacer 54; and inlet gas assembly 58 and inlet fuel assembly 60 of fuel injection stage 56 are all formed from material appropriate for the particular application (e.g., stainless steel), using conventional manufacturing techniques. As shown in FIGS. 2–6, the various components of the housing are connected together in a fluid-tight manner such as by bolts 136 extending through openings 137 in flanges 138 of the nose portion 36, inlet gas assembly 58 and inlet fuel assembly 60. Any other appropriate means can also be used for fixing the various components of the housing together, as should be appreciated by those skilled in the art.

Thus, liquid fuel entering inlet tubes 26 is provided through fuel nozzles 80 in a series of conical sprays, disposed in an annular arrangement at the upstream end of housing 25. The sprays from each of the nozzles carries downstream within the housing 25, and is prevented from contacting the outer wall of the housing by the cylindrical sheet of air provided through outer annular opening 132. Recirculation zones are prevented by the flow of air through central passages 130. The fuel sprays are vaporized by the elevated temperature of the air in the housing. The air flows also provide momentum for the fuel to pass downstream through the injector. When the fuel sprays reach the first air swirler stage 44, the inlet air imparts a swirl component to the sprays. As the fuel continues to pass downstream, the second air swirler stage 42 imparts a further swirl component to the fuel. The staging of the air swirlers prevents fuel centrifuging against the walls of the housing, and also causes the thorough and complete mixing of the fuel and air, at a point where the liquid fuel is essentially fully vaporized. The swirling fuel and air mixture (at a low velocity) then passes into the combustor, where clean and stable combustion is provided.

Alternatively (or in addition) to liquid fuel, gaseous fuel entering tube 28 is directed through gas nozzles 123. The gas then flows downstream and is thoroughly mixed and swirled by air provided by swirlers 42 and 44. The air entering through the outer annular passage 132, as well as through the central passages 130, prevents recirculation zones from forming, and provides sufficient momentum for the gas to pass downstream through the injector. The mixture then passes into the combustor for clean and stable combustion.

For an injection apparatus constructed according to the principles of the present invention with a single radial inflow swirler, at an inlet temperature of 500–600°F., equivalence ratio of 0.54 and residence time of 1.5–2.0 ms, $NO_x$ levels were detected in the range of 17 ppmv for dry, 15% $O_2$ (DF2). CO levels were less than 1 ppmv, dry, $O_2$ (DF2). Less than 3.4% RMS pressure fluctuations were observed. It is believed this is a significant decrease in these pollutants over comparable injection systems, and a significant increased in stability for liquid fuel. It is believed gaseous fuel combustion would have similar significant results. It is also believed two (or more) radial inflow swirlers would further reduce $NO_x$ levels. In any case, these results are accomplished without additional control of $NO_x$ levels, such as by water sprays or catalytic combustors.

Thus, as described above, the present invention provides a novel and unique fuel injector for a gas turbine combustion system which provides for the clean and stable ignition of fuel in a combustion chamber without the need for secondary control of $NO_x$.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A fuel injection apparatus, comprising:

a longitudinally extending housing having an upstream fuel inlet end and a downstream fuel outlet end;

a liquid fuel inlet to a plurality of liquid fuel spray devices in the housing, said liquid fuel spray devices supported in an annular arrangement in the housing to dispense liquid fuel in a spray in the downstream direction through the housing;

an air inlet to an upstream flow passage in the housing surrounding the liquid fuel spray devices to direct air in a cylindrical flow downstream around the liquid fuel spray; and a radial inflow swirler stage to a plurality of downstream flow passages, said downstream flow passages spaced downstream from the liquid fuel spray devices to direct a flow of air radially inward in a swirling motion in the housing to cause the fuel spray to swirl and thoroughly mix with air in the housing.

2. The fuel injection apparatus as in claim 1, wherein said liquid fuel spray devices are supported in circumferentially spaced-apart relation to one another to dispense liquid fuel in a plurality of sprays in the downstream direction through the housing.

3. The fuel injection apparatus as in claim 2, wherein said upstream flow passage includes i) an outer annular flow passage surrounding the arrangement of liquid fuel spray devices to direct air in a cylindrical flow downstream around the liquid fuel sprays; and ii) individual annular flow passages surrounding each of the liquid fuel spray devices to direct air downstream in a cylindrical flow around the sprays of each of the liquid fuel spray devices.

4. The fuel injection apparatus as in claim 3, wherein the outer annular flow passage is disposed between the fuel dispensing devices and the housing.

5. The fuel injection apparatus as in claim 4, wherein the outer annular flow passage surrounding the array of liquid fuel spray devices dispenses the air at about the same longitudinal location as the individual annular air flow passages surrounding each of the liquid fuel spray devices.

6. The fuel injection apparatus as in claim 2, wherein the liquid fuel spray devices are supported to dispense fuel at the same longitudinal location in the housing.

7. The fuel injector apparatus as in claim 2, wherein an inner air passage is supported centrally on the housing with respect to the annular arrangement of liquid fuel spray devices to direct air in the downstream direction centrally of the liquid fuel sprays.

8. The fuel injection apparatus as in claim 2, further including a gaseous fuel inlet passage in the housing to a plurality of gaseous fuel dispensing devices, said gaseous fuel dispensing devices supported in an annular arrangement to dispense gaseous fuel in a stream in the downstream direction through the housing.

9. The fuel injection apparatus as in claim 8, wherein the gaseous fuel dispensing devices are disposed in alternating circumferential relation with the liquid fuel spray devices.

10. The fuel injection apparatus as in claim 9, wherein the gaseous fuel dispensing devices are arranged in radial spokes, each of which projects radially outward from the longitudinal axis of the housing between adjacent liquid fuel spray devices.

11. The fuel injection apparatus as in claim 10, wherein the gaseous fuel dispensing devices have fuel openings which are radially larger in the gaseous fuel dispensing devices disposed radially further away from the longitudinal axis of the housing, than in the gaseous fuel dispensing devices disposed radially closer to the longitudinal axis.

12. The fuel injection apparatus as in claim 1, wherein the liquid fuel spray device comprises an atomizing spray nozzle, having a structure which forms a conical spray pattern.

13. The fuel injection apparatus as in claim 1, wherein the radial inflow swirler stage includes a plurality of inflow swirlers spaced longitudinally from each other, each of which directs air radially inward in a swirling motion at longitudinally-spaced locations in the housing.

14. The fuel injection apparatus as in claim 1, wherein the air inlet directs air in a cylindrical, non-swirling flow downstream around the liquid fuel spray to prevent accumulation of fuel on interior wall surfaces of the housing.

15. The fuel injection apparatus as in claim 14, further including a gaseous fuel inlet passage in the housing to a gaseous fuel dispensing device, the gaseous fuel dispensing device supported to dispense gaseous fuel in the downstream direction through the housing.

16. A fuel injection apparatus, comprising:

a longitudinally extending housing having an upstream fuel inlet end and a downstream fuel outlet end;

a liquid fuel inlet to a plurality of liquid fuel spray devices in the housing, said liquid fuel spray devices supported in the housing in an annular arrangement to dispense liquid fuel in sprays in the downstream direction through the housing;

a gaseous fuel inlet to a plurality of gaseous fuel dispensing devices, said gaseous fuel dispensing devices in the housing also supported in the housing in an annular arrangement to dispense gaseous fuel in streams in the downstream direction through the housing, the gaseous fuel dispensing devices located in alternating, circumferentially-spaced relation with the liquid fuel spray devices, and said plurality of gaseous fuel dispensing devices including a series of gaseous fuel dispensing devices arranged in radial spokes between each of the liquid fuel spray devices;

an air inlet to an annular flow passage in the housing surrounding the liquid fuel spray devices and the gaseous fuel spray devices to direct air in a cylindrical flow downstream in the housing; and a radial inflow air swirler stage in the housing, downstream from the liquid fuel spray devices and the gaseous fuel spray devices, said radial inflow air swirler stage directing air radially inward in a swirling motion to cause fuel and air to swirl and thoroughly mix in the housing.

17. The fuel injector apparatus as in claim 16, wherein the annular flow passage includes i) an outer annular flow passage surrounding all of the liquid fuel spray devices and the gaseous fuel dispensing devices; and ii) individual annular flow passages surrounding each of the liquid fuel spray devices to direct air downstream in a cylindrical flow around the sprays of each of the liquid fuel spray devices.

18. The fuel injection apparatus as in claim 17, wherein the outer annular flow passage is disposed between the fuel dispensing devices and the housing.

19. The fuel injection apparatus as in claim 18, wherein the outer annular flow passage surrounding the array of liquid fuel spray devices dispenses the air at about the same longitudinal location as the individual annular air flow passages surrounding each of the liquid fuel spray devices.

20. The fuel injection apparatus as in claim 16, wherein the liquid fuel spray devices are supported to dispense fuel at the same longitudinal location in the housing.

21. The fuel injection apparatus as in claim 16, wherein an inner air passage is supported centrally in the housing with respect to the arrangement of liquid fuel spray devices and gaseous fuel dispensing devices to direct air in the downstream direction centrally in the housing.

22. The fuel injection apparatus as in claim 16, wherein the liquid fuel spray device comprises an atomizing spray nozzle, having a structure which forms a conical spray pattern.

23. The fuel injection apparatus as in claim 16, wherein the gaseous fuel dispensing devices have fuel openings which are radially larger in the gaseous fuel dispensing devices disposed radially further away from the longitudinal axis of the housing, than in the gaseous fuel dispensing devices disposed radially closer to the longitudinal axis.

24. A fuel injection apparatus, comprising:

a longitudinally extending housing having an upstream fuel inlet end and a downstream fuel outlet end;

a liquid fuel inlet passage to a plurality of liquid fuel spray devices in the housing, said liquid fuel spray devices supported in an annular arrangement in the housing to dispense liquid fuel in a plurality of sprays in the downstream direction through the housing;

an air inlet passage to an annular flow passage in the housing surrounding at least one of the liquid fuel spray devices to direct air in a cylindrical flow downstream around the liquid fuel; and a radial inflow swirler stage in the housing spaced downstream from the liquid fuel spray devices, said radial inflow swirler stage including a pair of inflow swirlers spaced longitudinally from each other, each of which directs air radially inward in a swirling motion at longitudinally-spaced locations in the housing to cause the fuel sprays to swirl and thoroughly mix with air in the housing.

25. The fuel injection apparatus as in claim 24, wherein said annular flow passage includes i) an outer annular flow passage surrounding the arrangement of liquid fuel spray devices to direct air in a cylindrical flow downstream around the liquid fuel sprays; and ii) individual annular flow passages surrounding each of the liquid fuel spray devices in the arrangement to direct air downstream in a cylindrical flow around the sprays of each of the liquid fuel spray devices.

26. The fuel injection apparatus as in claim 25, wherein the outer annular flow passage is disposed between the fuel dispensing devices and the housing.

27. The fuel injection apparatus as in claim 26, wherein the outer annular flow passage surrounding the array of liquid fuel spray devices dispenses the air at about the same longitudinal location as the individual air flow passages surrounding each of the liquid fuel spray devices.

28. The fuel injection apparatus as in claim 27, wherein the liquid fuel spray devices are supported to dispense fuel at the same longitudinal location in the housing.

29. The fuel injector apparatus as in claim 24, wherein an inner air passage is supported centrally in the housing with respect to the annular arrangement of liquid fuel spray devices to direct air in the downstream direction centrally of the liquid fuel sprays.

30. The fuel injector apparatus as in claim 24, wherein an inner air passage is supported centrally with respect to the annular arrangement of liquid fuel spray devices to direct air in the downstream direction centrally of the liquid fuel sprays.

31. The fuel injection apparatus as in claim 24, wherein the liquid fuel spray devices comprise atomizing spray nozzles, each of which has a structure which forms a conical spray pattern.

32. A combustion system including a combustion chamber and a fuel injection apparatus, said fuel injection apparatus including:

a longitudinally extending injector housing having an upstream fuel inlet end and a downstream fuel outlet end, the downstream fuel outlet end in fluid communication with the combustion chamber;

a liquid fuel inlet passage to a plurality of liquid fuel spray devices in the housing said liquid fuel spray devices being supported in an annular arrangement in the housing to dispense liquid fuel in a plurality of sprays in the downstream direction through the housing;

an air inlet passage to an annular flow passage in the housing surrounding at least one of the liquid fuel spray devices to direct air in a cylindrical flow downstream around the liquid fuel; and a radial inflow swirler stage in the housing spaced downstream from the liquid fuel spray devices, said radial inflow swirler stage including a plurality of inflow swirlers spaced longitudinally from each other, each of which directs air radially inward in a swirling motion at longitudinally-spaced locations in the housing to cause the fuel sprays to swirl and thoroughly mix with air in the housing before passing into the combustion chamber.

33. A method for premixing liquid fuel and air within an injector before passing the mixture into a combustion chamber for combustion, comprising the steps of:

providing a longitudinally extending injector housing having an upstream fuel inlet end and a downstream fuel outlet end, the downstream fuel outlet end in fluid communication with the combustion chamber;

supplying liquid fuel to a plurality of liquid fuel spray devices supported in an annular arrangement in the housing and spraying the liquid fuel in a plurality of sprays in the downstream direction through the housing;

supplying air to an annular flow passage surrounding the liquid fuel spray devices and dispensing the air in a cylindrical flow downstream around the liquid fuel sprays; and supplying air to first and second radial inflow swirlers in the housing, said first and second radial inflow swirlers spaced longitudinally apart from one another downstream from the liquid fuel spray devices, and directing the air radially inward in a swirling motion at longitudinally-spaced locations in the housing to cause the liquid fuel and air to swirl and thoroughly mix within the housing prior to being provided to the combustor.

34. The method as in claim 33, wherein the air is supplied to the first and second air swirlers at about the same temperature.

35. The method as in claim 33, further including vaporizing the spray of fuel as the fuel passes downstream through the housing.

36. The method as in claim 33, wherein the air is directed i) to an outer annular flow passage surrounding the array of liquid fuel spray devices and dispensing the air in a cylindrical flow downstream around the liquid fuel sprays; and ii) to individual annular flow passages surrounding each of the liquid fuel spray devices and dispensing the air downstream in a cylindrical flow around the sprays of each of the liquid fuel spray devices.

37. The method as in claim 33, wherein the air is dispensed in a cylindrical, non-swirling flow downstream around the liquid fuel sprays to prevent the fuel accumulating on interior wall surfaces of the housing.

* * * * *